United States Patent [19]

Kwasnik et al.

[11] Patent Number: 4,726,465

[45] Date of Patent: Feb. 23, 1988

[54] COKE QUENCHING CAR

[75] Inventors: Hans-Jürgen Kwasnik, Herne; Hans-Günter Piduch, Bochum; August Lucas, Datteln-Horneburg, all of Fed. Rep. of Germany

[73] Assignees: Fa.Dr.C.Otto & Comp. GmbH; Firma Carl Still GmbH & Co. KG, both of Fed. Rep. of Germany

[21] Appl. No.: 874,286

[22] Filed: Jun. 13, 1986

[30] Foreign Application Priority Data

Jun. 15, 1985 [DE] Fed. Rep. of Germany ..... 3521540

[51] Int. Cl.[4] ..... C10B 39/14

[52] U.S. Cl. ..... 202/230; 105/254; 202/227

[58] Field of Search ..... 202/227, 230, 239, 262; 105/254, 255, 423, 240, 286, 287; 201/39

[56] References Cited

U.S. PATENT DOCUMENTS

| | | | |
|---|---|---|---|
| 3,970,526 | 7/1976 | Bender et al. | 202/227 |
| 4,010,695 | 3/1977 | Mantione | 105/254 |
| 4,104,130 | 8/1978 | Calderon | 202/230 |
| 4,201,627 | 5/1980 | Chuss et al. | 201/39 |
| 4,213,828 | 7/1980 | Calderon | 201/39 |
| 4,273,617 | 6/1981 | Goedde et al. | 201/39 |
| 4,396,461 | 8/1983 | Neubaum et al. | 201/39 |

FOREIGN PATENT DOCUMENTS 2919956 11/1980 Fed. Rep. of Germany .

*Primary Examiner*—Barry S. Richman
*Assistant Examiner*—Joye L. Woodard
*Attorney, Agent, or Firm*—McGlew and Tuttle

[57] ABSTRACT

A quenching car from coke ovens that serves to receive a carbonized batch from an oven chamber while standing still and is capable of travel alongside a battery of coke ovens to a point under a quenching tower, includes a coke receptacle which is designed as a rectangular box. The receptacle is equipped with a slanted bottom that slants down toward a coke ramp that lies on a side of the car opposite the battery of coke ovens. A front wall of the receptacle facing the coke ramp, is equipped on its lower portion along its entire length with a flap that swings outwardly and which can be pivoted by means of an operating rod and a first operating device from a position in which it holds the receptacle tightly closed into a position in which it is open by the space of a crack in the area of the low point of the slanting bottom. The dump opening of the receptacle meanwhile remains closed by a inner, grate-like flap lining. A second operating device is also provided that also acts on the operating rod independently of the first device and can open the flap to its full extent with the inner flap lining.

15 Claims, 8 Drawing Figures

COKE QUENCHING CAR

FIELD AND BACKGROUND OF THE INVENTION

The invention relates to a quenching car for coke ovens that serves to receive a carbonized batch from an oven chamber while standing still and is capable of travelling alongside a battery of coke ovens to a point under a quenching tower of the battery. The quenching car has a coke receptacle which is designed as a rectangular box and is equipped with a slanted bottom that slants down towards a coke ramp that lies on the side opposite the battery of coke ovens.

Quenching cars, which are known as "one-point" cars, are part of the state of the art. A quenching car of this kind is disclosed in German Pat. Disclosure (Offenlegungschrift) No. 29 19 956. This car has a part that can pivot around a horizontal axis and, when tilted to its highest position, enables the quenched coke to be unloaded onto the ramp. With prior art receptacles, it is necessary to equip the rim of the bottom of the receptacle with a sealing strip along its entire length that fits against a lower ends of the receptacle walls. A seal that is as perfect as possible is desirable because the coke is supposed to be quenched by floating the batch. In other words, the quenching water must first be collected in the coke receptacle and allowed to run out in a regulated fashion during or after quenching, before the quenched coke is fed onto the ramp.

SUMMARY OF THE INVENTION

The invention seeks to solve the problem of designing a coke receptacle with a tight, stationary bottom in such a way that the discharge of the quenching water during or after quenching can be regulated and accomplished independently of the dumping of the coke.

Assuming a coke quenching car of the kind described at the beginning, the invention consists in having the front wall of the receptacle facing the coke ramp equipped on its bottom section along its entire length with a flap that can swing outwardly and can be pivoted by means of an operating rod and a first operating device from a position in which it closes the receptacle tightly to a position in which it leaves open a crack that appears at the low point of the slanted bottom, wherein the pass-through area of the crack is defined by a grate-like lining of the flap positioned at an interval from it on the side facing the receptacle. A second operating device is also provided that acts on the operating rod independent of the first device and with which the flap, together with the inner flap lining, can be opened to its full extent.

The invention also provides that the operating device for creating the crack-like opening should consist of a carriage positioned at either end of the receptacle, which carriage can be moved by means of a piston-cylinder arrangement transversely to the direction of travel of the coke quenching car to the extent of the desired crack width and is connected to the operating rod. Preferably, the operating device for fully opening of the flap should consist of a piston-cylinder arrangement that is mounted on the back end of a housing for the movable carriage and has its shiftable piston connected to the operating rod.

In a preferred embodiment of the invention, the operating rod is connected to one arm of a toggle joint. The other arm of the toggle joint is connected to the shiftable piston for fully opening the flap. The toggle joint is attached to the front end of the housing of the shiftable carriage.

It is helpful to provide the flap with a surrounding, flexible sealing strip, which in its closed position, is pressed against a rest surface bordering the opening of the receptacle. On the side of the flap facing the receptacle, a lining is provided which is with a space between it and the flap that is designed as a stationary grate with a number of parallel, lengthwise gaps. This grate-like lining is connected to the flap in such a way that when the flap opens, leaving the crack, the receptacle is still closed by the grate. The amount of quenching water draining out of the receptacle is thus dependent on the area of opening that is created by the gaps between the bars of the grate-like lining. These gaps, moreover, widen conically outwardly from the quenching receptacle towards the coke ramp, in other words, in the direction of flow of the quenching water. This means that the discharge gaps cannot fill up with coke breeze or small pieces of coke, but are instead washed clean by the outgoing quenching water. Furthermore, adequate static stability against the mechanical stress of the falling coke is insured by the fact that the bars, which are conical in cross-section, of the grate-like flap lining, absorb the stress in an edgewise direction. In other words, in cross-section their longer dimension is at right angles to the flap running the length of the front wall.

The invention further provides for creating a space to receive quenching water between the tight bottom of the receptacle and plates that are set in at an interval from the bottom, and having the water flow into that space through gaps that are left between the plates. In addition, the two end walls and the front wall of the coke receptacle can be faced with plates that are held at an interval from the walls by stays, thereby creating steam and water venting spaces. The plates are placed next to and over one another, leaving gaps of predetermined widths. The plates used to create the double bottom and double walls should preferably be made of cast iron.

The one-point quenching car pursuant to the present invention serves to receive a batch while standing still, which has the advantage over the quenching car that is travelling while it receives the coke that the discharge of the emissions created by the force of the fall can be better controlled. The continuous flap, which in closed position fits tight against the opening with a sealing strip, can at first be moved to a position in which only a crack for the discharge of water during or after quenching is opened. Because of the grate-like inner flap lining that lies before it, this crack is not blocked by pieces of coke, but is fully available for run-off of the quenching water. In this way, it is possible to float the batch during quenching and to draw off the quenching water in a quick and controlled manner. By an independent mechanism, the flap, together with the inner flap lining, may be opened to its full extent to unload the coke.

Accordingly, an object of the present invention is to provide a quenching car which has a receptacle with a front wall having a lower opening, the opening being closable by a pivotably mounted flap and including two operating devices for opening the flap by a small crack amount to discharge water from the receptacle, and by a larger fully open amount for discharging a batch from the receptacle.

A further object of the invention is to provide a quenching car which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings, which schematically depict one embodiment of the invention.

DESCRIPTION OF THE PREFERRED EMBODIMENT

Figure 1:
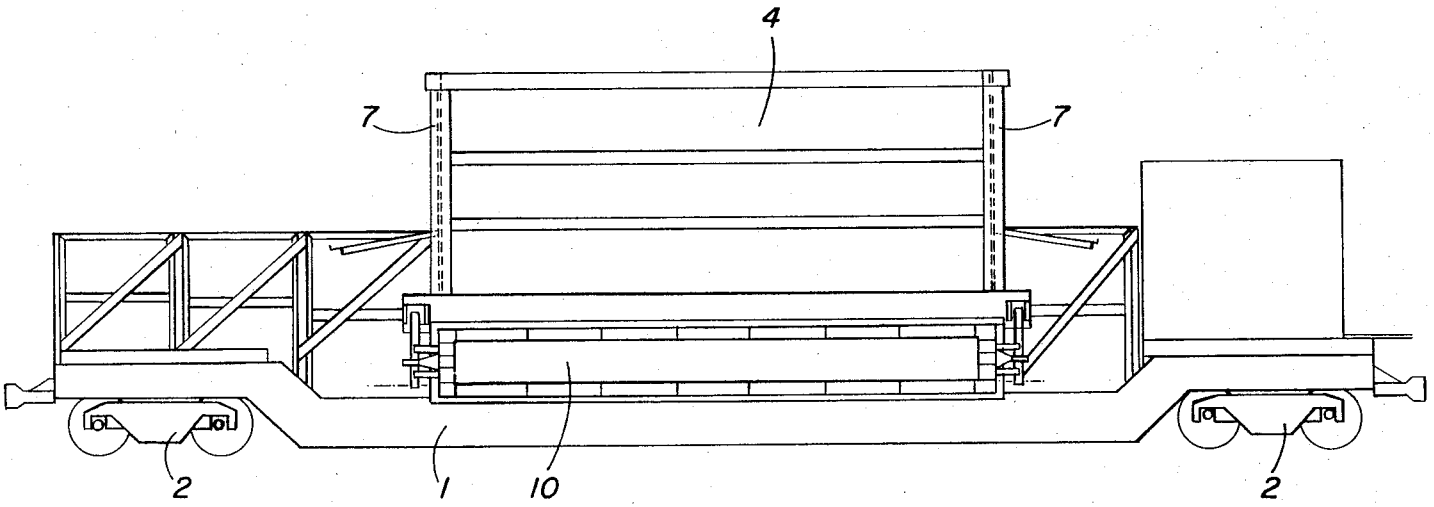
FIG. 1 is a side view of a coke quenching car.
Figure 2:
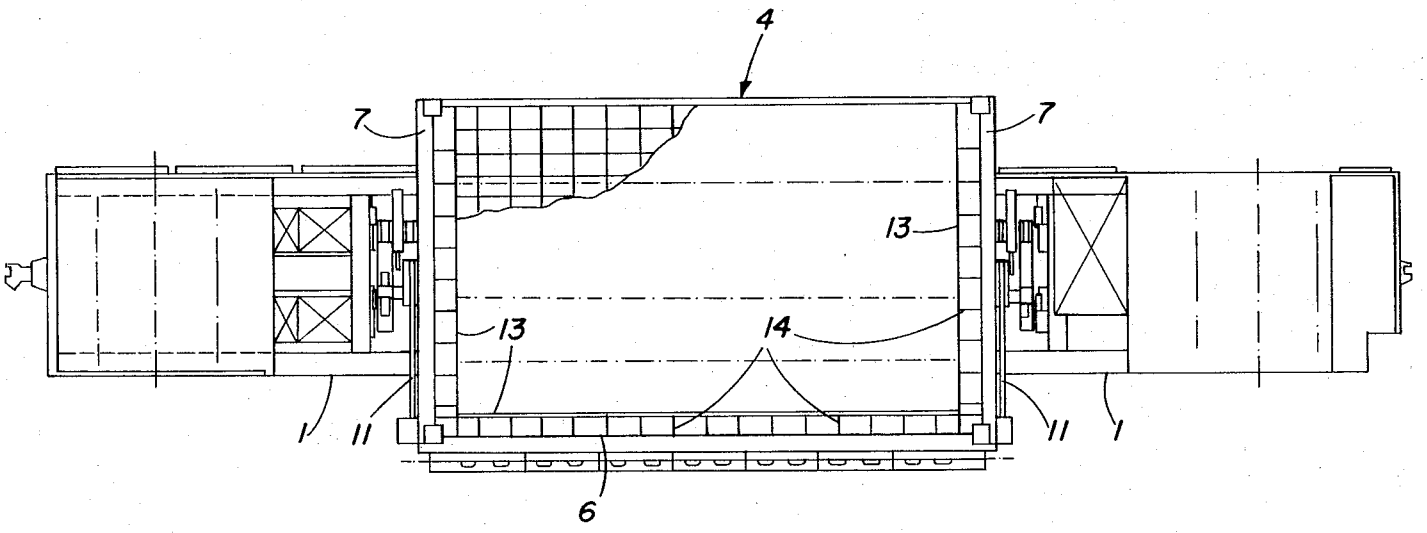
FIG. 2 is a top view of the quenching car shown in FIG. 1.
Figure 3:
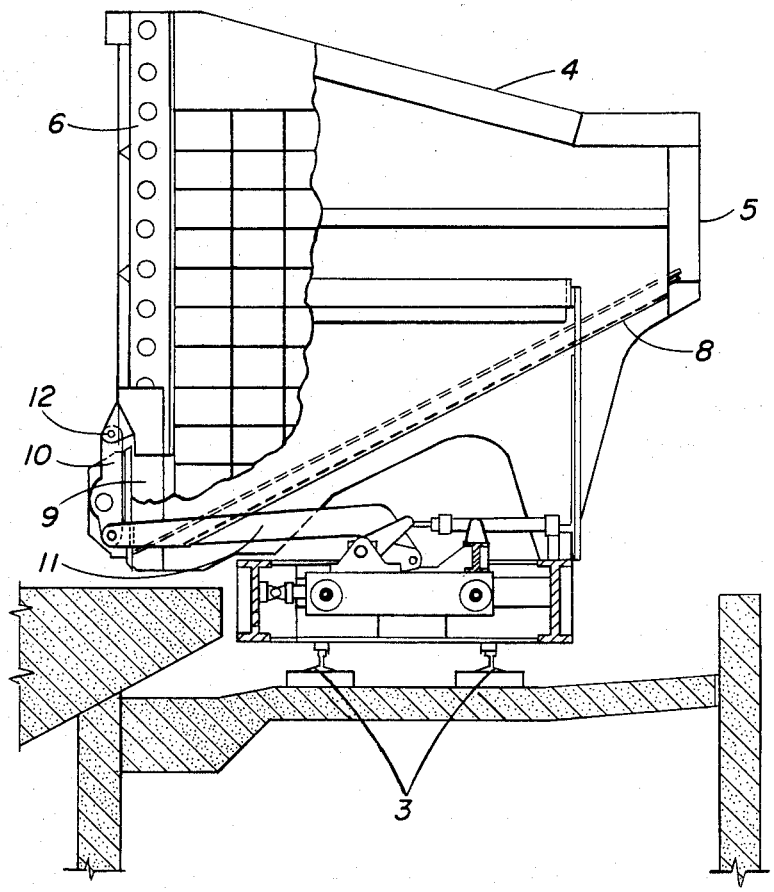
FIG. 3 is a partially cut-away end view of the coke receptacle.

The coke quenching car 1 shown in FIGS. 1, 2 and 3 travels on its running gear 2, on rails 3 alongside a battery of coke ovens to a point under a quenching tower standing at the end of the battery of coke ovens. The mid-section of the quenching car carries a receptacle 4 for a carbonized batch of glowing coke, which is pushed out of a chamber of the coke oven battery. The coke receptacle 4 is designed in the shape of a rectangular box and consists of a back wall 5 facing the coke oven battery, a front wall 6, two end walls 7 and a slanted bottom 8, which slants downwardly toward a ramp of the battery not shown. The front wall 6 of the receptacle pursuant to the invention has an opening 9 at its lower end, which runs the entire length of the front wall. The opening is closable by a flap 10 that can be opened and shut by means of an operating rod 11 and pivots on an upper pivot point 12 on the lower end of the front wall.

FIGS. 2 and 3 show that the two end walls and the front wall of the coke receptacle are faced with plates 13, preferably of cast iron, that are held at an interval from the outer walls 6 and 7 by stays. In this manner, hollow spaces are created between the plates 13 and the outer walls 6 and 7 that serve as discharge spaces for venting steam and water. The cast iron plates do not touch, but are arranged with predetermined gaps next to and over one another. These gaps left between the separate plates let steam and water pass through into the discharge spaces. The water-tight discharge spaces are equipped underneath with slide or other valves, (not shown) that allow for regulated discharge of water during or following the quenching process. The bottom of the receptacle 8 is also similarly designed as a double bottom, as can be seen in FIG. 3.

Figure 4:
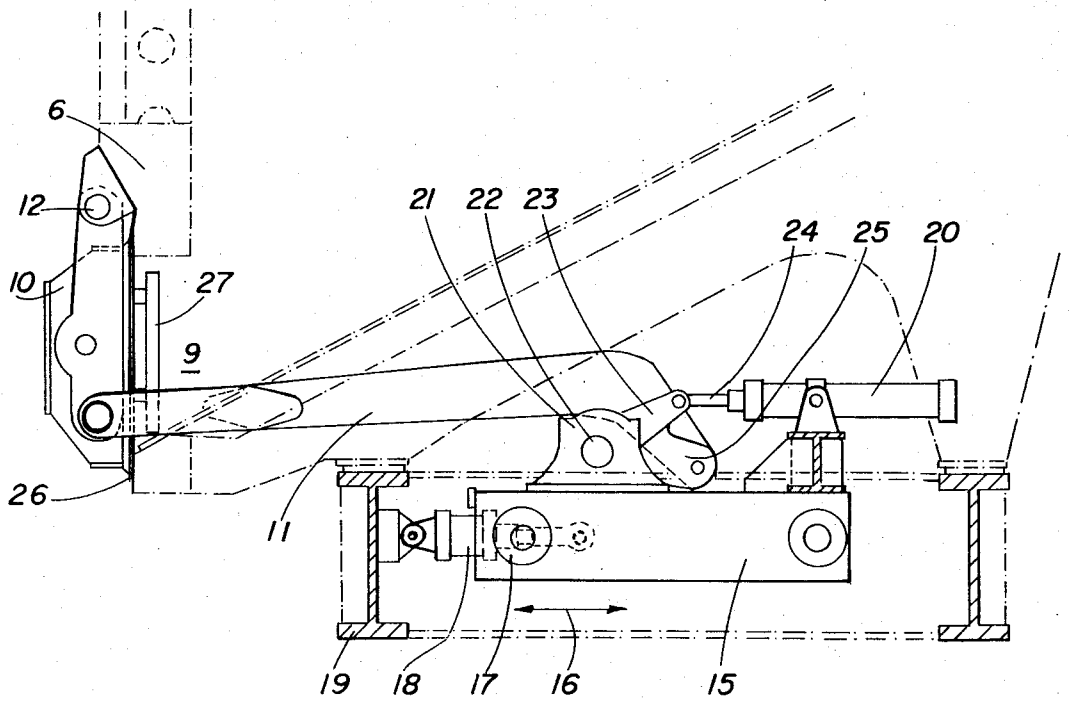
FIG. 4 is an enlarged view corresponding to FIG. 3 of the lower section of the coke receptacle with the operating devices for the flap, showing the flap in its closed position.
Figure 5:
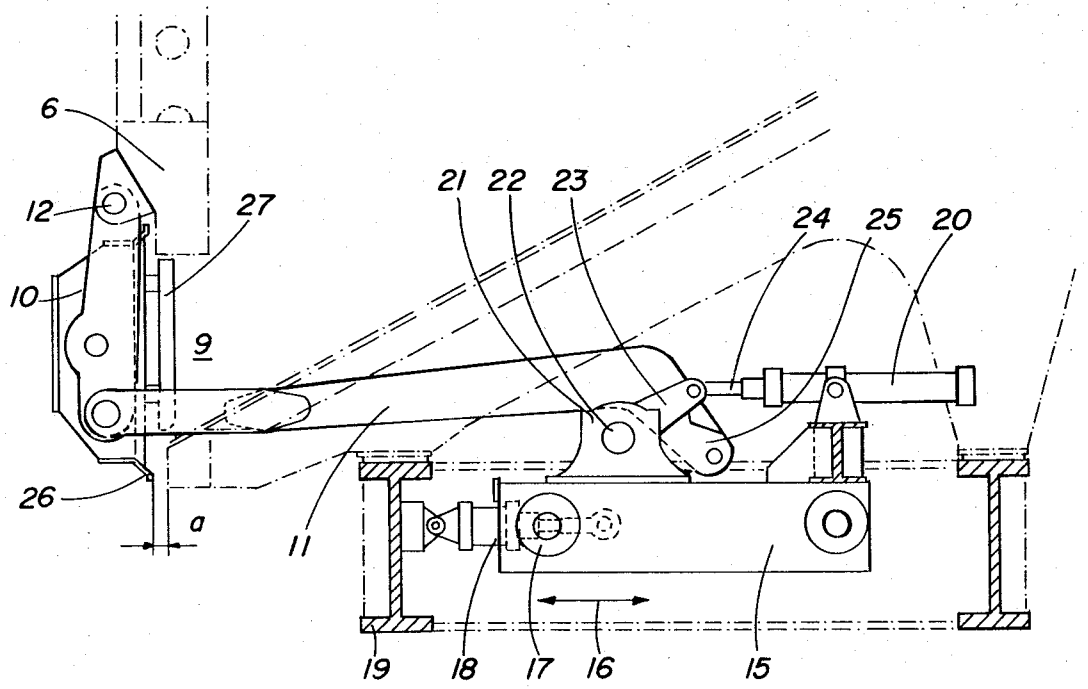
FIG. 5 is similar to FIG. 4 but with the flap opened the width of a crack "a"
Figure 6:
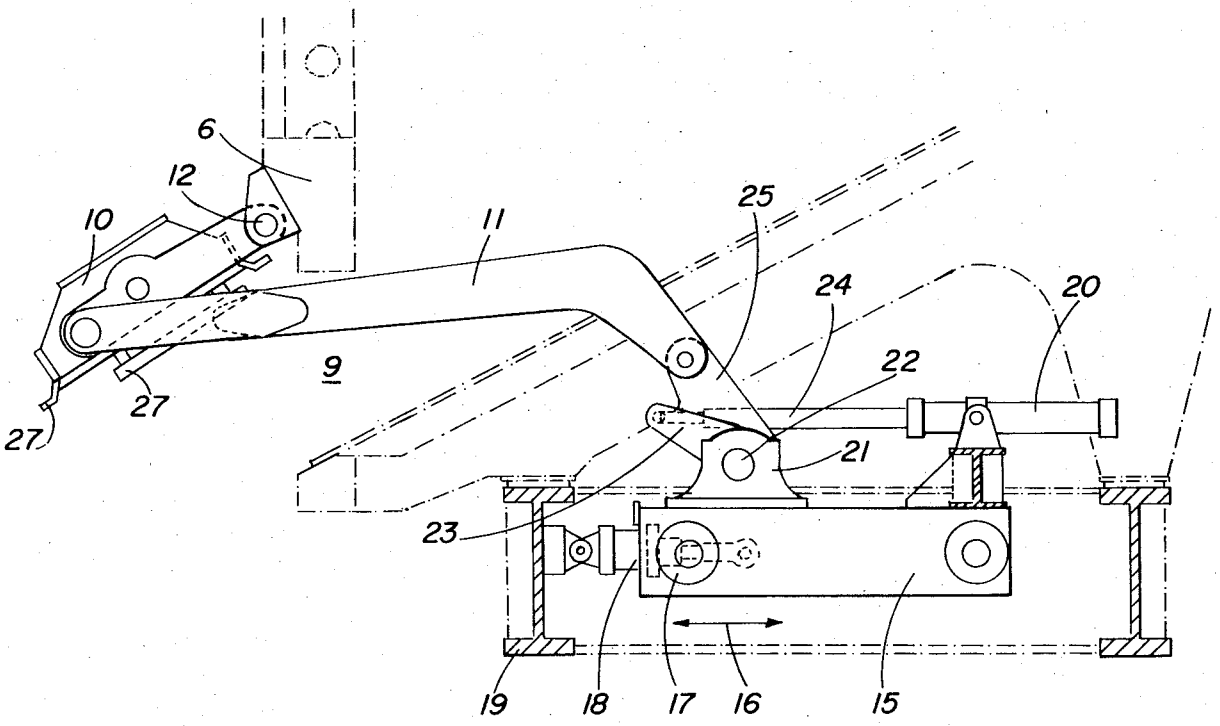
FIG. 6 is similar to FIG. 4 but with the flap in its fully opened position.

FIGS. 4, 5 and 6 show the operating devices for the flap 10 in enlarged detail. The device for opening the flap by the width of a crack "a" (FIG. 5) consists of a carriage 15 capable of movement on wheels 17 transversely to the direction of travel of the coke quenching car, as shown by arrows 16. The movement is accomplished by activating a short-stroke piston-cylinder set 18, which is attached on one end to an I-beam 19 of the coke quenching car and on the other end to the carriage 15. A device 20 is mounted on the upper rear end of the carriage for opening the flap 10 to its full extent. This device can travel along with the carriage 15 and also consists of a piston-cylinder set (this time a long-stroke set) that can be operated independently of device 18. Set 20 has a piston 24. At the upper front end of the carriage, a toggle joint 21 with a pivot point designated at 22 is attached.

The piston 24 is pivotally attached to one arm 23 of the joint. The other arm 25 of the toggle joint is pivotally attached to the operating rod 11.

In order to move the flap 10 from the closed position shown in FIG. 4 to the position shown in FIG. 5 in which it is open by the width of a crack "a", the carriage 15 is moved by the operating device 18 a corresponding distance, carrying with it device 20 and the toggle joint, the positions of which remain unchanged for the time being. In the process, the inner grate-like lining 27 of the flap covers the flap in such a way, thanks to its dimensions or manner of attachment, that it still keeps the receptacle closed in the position in which crack "a" is opened. The grate-like lining is positioned over the crack "a" in FIG. 5.

In order to open the flap 10 fully, together with the inner flap lining 27, the piston 24 of operating device 20 is extended, which action pivots the toggle joint 21 and the operating rod 11, pivotally attached to the lower end of the flap 10, into the position shown in FIG. 6, and the flap assumes its open position. Reversing the process, in order to close the flap, first the piston 24 and then the carriage 15 are moved back to their starting positions. In the process, the flexible sealing strip 26 that extends around and beyond the flap 10 is firmly pressed against the rim of the opening 9.

Figure 8:
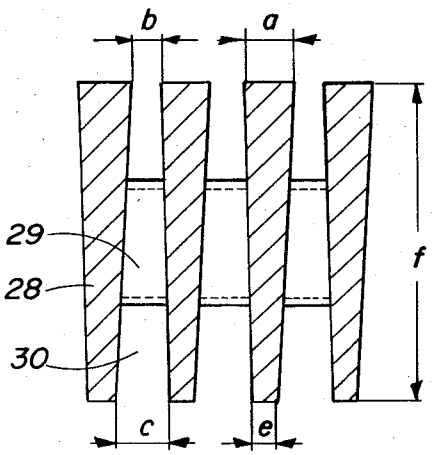
FIG. 8 is a detail cross-sectional view of the flap lining.
Figure 7:
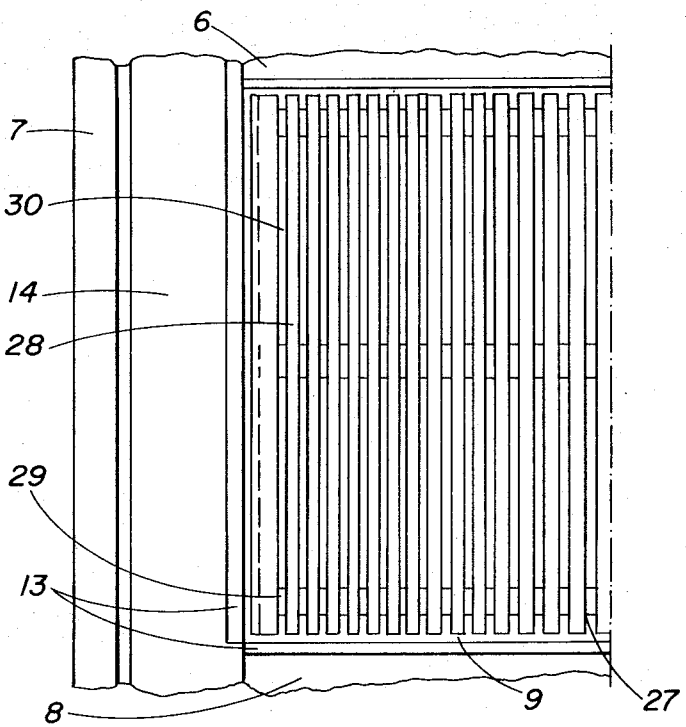
FIG. 7 is an enlarged detail of the flap taken from FIGS. 3 through 6, showing a partial view of the receptacle through the flap lining.

FIGS. 7 and 8 depict enlarged views of the receptacle showing the inner, grate-like lining 27 of the flap, which is either firmly fixed to the flap 10 or movably attached to it by means of joints. As shown in FIG. 7, the flap lining is composed of individual bars 28 and spacers 29 placed between them. The lining 27 can be attached to the flap 10 as a complete component, in several segments, or in separate parts. As shown in FIG. 8, the gaps 30 between the bars 28 are set by the spacers 29 and taper outwardly from inside the "c". Gaps or spaces 30 have a length "f". The space 30 between bars 28 tapers outwardly in that the inner edges of the bars have a larger dimension "d" while the outer edge of the bars have a narrower dimension "e".

The individual bars 28 are made of heat-resistant material as are the spacing pieces 29. The grate 27 is also interchangably or removably connected to the flap 10.

Preferred dimensions for the grate include an inner edge spacing (b) of from about 10 to 20 mm, and preferably 15 mm. The outer edge interval "c" is preferably 20 to 30 mm and preferably 25 mm, hence wider than the spacing "b".

While a specific embodiment of the invention has been shown and described in detail to illustrate the application of the principles of the invention, it will be understood that the invention may be embodied otherwise without departing from such principles.

What is claimed is:

1. A quenching car for receiving a carbonized batch from an oven chamber of a battery of coke ovens while the quenching car stands still, and which is capable of travelling along the battery to a point under a quenching tower of the battery at which the batch can be discharged comprising:

running gear means for movement in a travel direction along a battery of coke ovens;

a coke receptacle mounted on said running gear means for movement along the battery, said coke receptacle being in the form of a rectangular box having a slanted bottom with a discharge edge over which the batch is discharged, a pair of end walls spaced from each other in a travel direction and a front and back wall connected to said end walls, said front wall, end walls and slanted bottom defining an inner space, said front wall extending parallel to the travel direction and having a lower opening extending a full length of said front wall in the travel direction between said end walls;

a flap pivotally mounted to said coke receptacle for swinging outwardly of said inner space to uncover said lower opening and inwardly toward said inner space and against said discharge edge for closing said lower opening;

a grate-like lining connected to said flap and spaced inwardly of an inner surface of said flap facing inwardly of said inner space with said flap closing said lower opening, said lining being over said lower opening with said flap closing said lower opening;

an operating rod having one end pivotally mounted to said flap and being movable to swing said flap outwardly for uncovering said lower opening, said operating rod having an opposite end;

first operating means connected to said receptacle and connected to said opposite end of said operating rod, said first operating means being activatable for moving said operating rod to swing said flap to a first open position wherein said flap is spaced by a small pass-through area from said discharge end and said slanted bottom and said grate-like lining being maintained over said lower opening for permitting a flow of quenching water out of said inner space through said lining while retaining a carbonized batch in said inner space;

second operating means connected to said receptacle and connected to said opposite end of said operating rod, said second operating means being activatable independently of said first operating means for moving said operating rod to swing said flap into a second open position fully uncovering said lower opening, said second position of said flap permitting the batch slide off said slanting bottom through said lower opening;

said first operating means comprising a carriage mounted to said receptacle for movement transversely to the travel direction, a first piston-cylinder set connected between said receptacle a said carriage for moving said carriage transversely of the travel direction, said opposite end of said operating rod being operatively connected to said carriage so that with activation of said first piston-cylinder set, said operating rod is moved to move said flap into its first open position;

said second operating device comprising a second piston-cylinder set connected between said carriage and said opposite end of said operating rod, said carriage having a rear end spaced away from said lower opening and a front end adjacent said lower opening, said second piston-cylinder set having a cylinder connected to said carriage at said rear end thereof and a piston movable in said cylinder and connected to said opposite end of said operating rod; and, a double arm toggle joint pivotally connected to said carraige at said front end thereof, said toggle joint having a first arm connected to said piston of said second piston-cylinder set and a second arm connected to said opposite end of said operating rod.

2. A quenching car according to claim 1, including a flexible sealing strip connected around a periphery of said flap and engagable with a periphery of said lower opening for sealing said lower opening with said flap in its position covering said lower opoening.

3. A quenching car according to claim 1, including a flexible sealing strip connected around a periphery of said flap and engagable with a periphery of said lower opening for sealing said lower opening with said flap in its position covering said lower opening.

4. A quenching car according to claim 1, wherein said lining is fixed to said flap and includes a plurality of parallel gaps extending transversely to the travel direction.

5. A quenching car according to claim 1, wherein said lining is fixed to said flap and includes a plurality of parallel gaps extending transversely to the travel direction.

6. A quenching car according to claim 1, wherein said small pass-through area, with said flap in its first opening position, is at least partly covered by said grate-like lining.

7. A quenching car according to claim 6, wherein said lining is fixed to said flap and has a plurality of parallel openings therein extending transversely to the travel direction.

8. A quenching car according to claim 4, wherein said lining comprises a plurality of individual parallel bars, adjacent bars forming each parallel gap, and spacing pieces connected between said bars for maintaining said gaps.

9. A quenching car according to claim 8, wherein said bars and spacing pieces are interchangeably and removeably connected to said flap.

10. A quenching car according to claim 1, including plates connected to, and spaced over said slanting bottom defining a hollow space which can be filled with quenching water from said inner space.

11. A quenching car according to claim 1, including a plurality of lining plates connected to and spaced inwardly of said front wall and said end walls, said plates forming hollow spaces with said front and end walls for permitting the passage of steam and water discharged from said inner space.

12. A quenching car according to claim 11, including additional plates mounted to and spaced above said slanting bottom for defining a gap with said slanting bottom, all of said plates being made of cast iron.

13. A quenching car for receiving a carbonized batch from an oven chamber of a battery of coke ovens while the quenching car stands still, and which is capable of travelling along the battery to a point under a quenching tower of the battery at which the batch can be discharged comprising:

running gear means for movement in a travel direction along a battery of coke ovens;

a coke receptacle mounted on said running gear means for movement along the battery, said coke receptacle being in the form of a rectangular box having a slanted bottom with a discharge edge over which the batch is discharged, a pair of end wall spaced from each other in a travel direction and a front and back wall connected to said end walls, said front wall, end walls and slanted bottom defining an inner space, said front wall extending parallel to the travel direction and having a lower opening extending a full length of said front wall in the travel direction between said end walls;

a flap pivotally mounted to said coke receptapcle for swinging outwardly of said inner space to uncover said lower opening and inwardly toward said inner space and against said discharge edge for closing said lower opening;

a grate-like lining connected to said flap and spaced inwardly of an inner surface of said flap facing inwardly of said inner space with said flap closing said lower opening, said lining being over said lower opening with said flap closing said lower opening;

an operating rod having one end pivotally mounted to said falp and being movable to swing said flap outwardly for uncovering said lower opening, said operating rod having an opposite end;

first operating means connected to said receptacle and connected to said opposite end of said operating rod, said first operating means being activatable for moving said operating rod to swing said flap to a first open position wherein said flap is spaced by a small pass-through area from said discharge edge and said slanted bottom, and said grate-like lining being maintained over said lower opening for permitting a flow of quenching water out of said inner space through said lining while retaining a carbonized batch in said inner space;

second operating means connected to said receptacle and connected to said operating means being activatable independently of said first operating means for moving said operating rod to swing said flap into a second opeon position fully uncovering said lower opening, said second position of said flap permitting the batch to slide of said slanting bottom through said lower opening;

said first operating means comprising a carriage mounted to said receptacle for movement transversely to the travel direction, a first piston-cylinder set connected between said receptacle and said carriage for moving said carriage transversely of the travel direction, said opposite end of said operating rod being operativley connected to said carriage so that with activation of said first piston-cylinder set, said operating rod is moved to move said flap into its first position;

said second operating device comprising a second piston-cylinder set connected between said carriage and said opposite end of said operating rod, said carriage having a rear end spaced away from said lower opening and a front end adjacent said lower opening, said second piston-cylinder set having a cylinder connected to said carriage at said rear end thereof and a piston movable in said cylinder and connected to said opposite end of said operating rod;

a double arm toggle joint pivotally connected to said carriage at said front end thereof, said toggle joint having a first arm connected to said piston of said second piston-cylinder set and a second arm connected to said opposite end of said operating rod;

said lining being fixed to said flap and includes a plurality of parallel gaps extending transversely to the travel direction;

said lining comprising a plurality of individual parallel bars, adjacent bars forming each parallel gap, and spacing pieces connected between said bars for maintaining said gaps; and, said bars being shaped so that gaps taper outwardly from said inner space outwardly with respect to said lower opening, a length of each gap being a multiple of a width of each bar, the length of each gap extending transversely to said travel direction and transversely to a plane containing said gap.

14. A quenching car according to claim 13, wherein each tapering gap has a width adjacent said inner space of from about 10 to 20 mm, each gap having a width near an edge of said bars spaced away from said inner space of from 20 to 30 mm.

15. A quenching car according to claim 14, wherein said gap width adjacent said inner space is about 15 mm and said gap width at said end of said bars spaced from said inner space being about 25 mm.

* * * * *